US008803705B2

(12) United States Patent
Li

(10) Patent No.: US 8,803,705 B2
(45) Date of Patent: Aug. 12, 2014

(54) TRAFFIC MANAGEMENT SYSTEM

(75) Inventor: Jian-Hui Li, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 499 days.

(21) Appl. No.: 13/095,883

(22) Filed: Apr. 28, 2011

(65) Prior Publication Data

US 2012/0169515 A1 Jul. 5, 2012

(30) Foreign Application Priority Data

Dec. 30, 2010 (CN) ..... 2010 1 0614536

(51) Int. Cl.

| | |
|---|---|
| ***G08B 29/00*** | (2006.01) |
| ***G08G 1/07*** | (2006.01) |
| ***G08G 1/00*** | (2006.01) |
| ***G08G 1/08*** | (2006.01) |

(52) U.S. Cl.

USPC ..... 340/907; 340/906; 340/908.1; 340/909; 340/914; 340/917; 340/922; 340/932.1; 340/510

(58) Field of Classification Search

USPC ..... 340/995.13, 901–995, 510

See application file for complete search history.

(56) References Cited

U.S. PATENT DOCUMENTS

| | | | | | |
|---|---|---|---|---|---|
| 3,075,173 | A * | 1/1963 | Paul | 340/916 |
| 3,231,856 | A * | 1/1966 | Auer, Jr. | 340/926 |
| 5,400,019 | A * | 3/1995 | Riscoe, Jr. | 340/908 |
| 5,470,171 | A * | 11/1995 | Tseng | 404/13 |
| 5,646,615 | A * | 7/1997 | Moore | 340/940 |
| 5,798,983 | A * | 8/1998 | Kuhn et al. | 367/135 |
| 5,865,274 | A * | 2/1999 | Kiji et al. | 187/380 |
| 6,177,885 | B1 * | 1/2001 | Weil et al. | 701/117 |
| 6,204,778 | B1 * | 3/2001 | Bergan et al. | 340/936 |
| 6,374,745 | B1 * | 4/2002 | Pichlmeier | 104/130.02 |
| 6,633,238 | B2 * | 10/2003 | Lemelson et al. | 340/909 |
| 6,696,977 | B2 * | 2/2004 | Thompson et al. | 340/905 |
| 7,098,807 | B2 * | 8/2006 | Seguin et al. | 340/907 |
| 7,203,598 | B1 * | 4/2007 | Whitsell | 701/521 |
| 7,307,548 | B2 * | 12/2007 | Park et al. | 340/928 |
| 7,336,203 | B2 * | 2/2008 | Arquette et al. | 340/928 |
| 7,439,853 | B2 * | 10/2008 | Tengler et al. | 340/466 |
| 7,860,639 | B2 * | 12/2010 | Yang | 701/117 |
| 7,991,542 | B2 * | 8/2011 | Giles et al. | 701/119 |
| 8,046,166 | B2 * | 10/2011 | Cabral et al. | 701/461 |
| 8,109,692 | B2 * | 2/2012 | Welch et al. | 404/86 |
| 2002/0190856 | A1 * | 12/2002 | Howard | 340/531 |
| 2003/0060969 | A1 * | 3/2003 | Waite et al. | 701/117 |
| 2005/0073434 | A1 * | 4/2005 | Arquette et al. | 340/907 |
| 2006/0155427 | A1 * | 7/2006 | Yang | 701/1 |
| 2010/0250107 | A1 * | 9/2010 | Desai et al. | 701/118 |
| 2011/0221614 | A1 * | 9/2011 | Al-Hasan | 340/907 |

* cited by examiner

*Primary Examiner* — Steven Lim
*Assistant Examiner* — Muhammad Adnan
(74) *Attorney, Agent, or Firm* — Novak Druce Connolly Bove + Quigg LLP

(57) ABSTRACT

A traffic management system includes a data processing unit which communicates with a road leading unit and a vehicle management unit. The road leading unit comprises a plurality of grooves and isolation railings, the grooves are formed on a road, and the isolation railings are received in the grooves and can be opened to divide the road. The data processing unit can receive vehicle identification information and driving direction information from the vehicle management unit. The data processing unit comprises a data analysis module and a control module. The data analysis module is operable to estimate road condition information and count a total traffic demand index for each road according to the vehicle identification information and the driving direction information. The control module is operable to control the isolation railings to open or retract according to the total traffic demand index.

14 Claims, 2 Drawing Sheets

TRAFFIC MANAGEMENT SYSTEM

BACKGROUND

1. Technical field

The disclosure generally relates to traffic management systems, particularly to a traffic management system based on near field communications.

2. Description of the Related Art

Traffic problems are becoming more problematic. On one hand, during rush hour, there are usually more vehicles heading downtown than there are people leaving downtown when people go to work, and the situation is the opposite when people get off work. During this time, it is easy to be in a traffic jam. On the other hand, since the vehicles and traffic roads lack wireless communication, drivers cannot directly and conveniently get road condition information ahead, so that the drivers will find the traffic jam when they drive in a congested road. Then, the traffic jam may become more serious.

Therefore, there is room for improvement within the art.

BRIEF DESCRIPTION OF THE DRAWINGS

Many aspects of an exemplary traffic management system can be better understood with reference to the following drawings. The components in the drawings are not necessarily drawn to scale, the emphasis instead being placed upon clearly illustrating the principles of the exemplary traffic management system. Moreover, in the drawings, like reference numerals designate corresponding parts throughout the several views. Wherever possible, the same reference numbers are used throughout the drawings to refer to the same or like elements of an embodiment.

DETAILED DESCRIPTION

Figure 1:
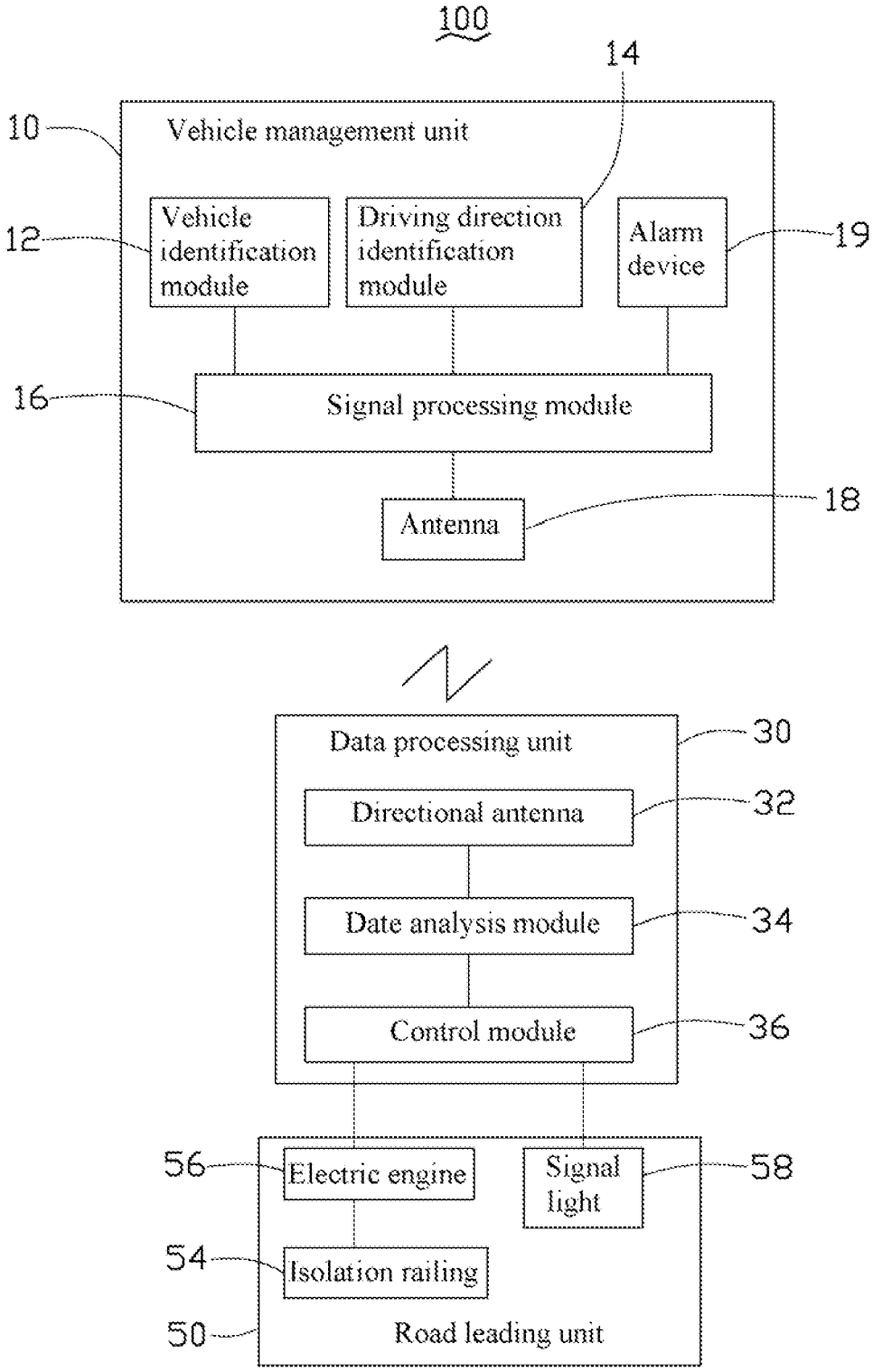
FIG. 1 is a block diagram of a traffic management system, according to an exemplary embodiment.

FIG. 1 is a block diagram of a traffic management system 100, according to an exemplary embodiment. The traffic management system 100 includes a vehicle management unit 10, a data processing unit 30, and a road leading unit 50.

The vehicle management unit 10 is located in a vehicle (e.g., motor vehicle). The vehicle management unit 10 includes a vehicle identification module 12, a driving direction identification module 14, a signal processing module 16, an antenna 18, and an alarm device 19. The vehicle identification module 12, the driving direction identification module 14, the antenna 18, and the alarm device 19 are all electronically connected to the signal processing module 16.

The modules 12, 14, and 16 may include one or more computerized instructions in the form of one or more programs that are stored in a computer-readable medium of the vehicle management unit 10, executed by a processor (not shown) to perform operations of the vehicle management unit 10. In general, the word "module", as used herein, refers to logic embodied in hardware or firmware, or to a collection of software instructions, written in a programming language, such as, Java, C, or Assembly. One or more software instructions in the modules may be embedded in firmware, such as EPROM. The modules described herein may be implemented as either software and/or hardware modules and may be stored in any type of computer-readable medium or other storage device.

The vehicle identification module 12 has a predetermined vehicle identification number and corresponding vehicle identification information. In this exemplary embodiment, the vehicle identification information includes the type of the vehicles and the number of seats of the each vehicle. For example, the vehicle type can be a truck, a public transit bus, or a private bus. The vehicle identification module 12 is capable of transmitting the vehicle identification information to the signal processing module 16.

The driving direction identification module 14 can communicate with a global positioning system (GPS) module (not shown) located in the vehicle to obtain driving direction information of the vehicle. The driving direction identification module 14 is also capable of transmitting the driving direction information to the signal processing module 16.

The signal processing module 16 is operable to convert the vehicle identification information and the driving direction information into radio frequency (RF) signals. The antenna 18 is operable to send the RF signals to the data processing unit 30 and receive wireless signals of road condition information form the data processing unit 30. Moreover, the signal processing module 16 is operable to encode the wireless signals to get corresponding electric signals. The alarm device 19 is directed by the electric signals to show present road condition information. The alarm device 19 includes three indication lights (not shown). In this exemplary embodiment, the three indication lights are positioned side by side. The middle indication light represents information of the road condition ahead of the vehicle. The left indication light represents information of the road condition on the left side of the vehicle, and the right indication light represents the right side of the vehicle. Each indication light can show red, yellow, and green to represent severe, moderate, and light traffic, respectively.

The data processing unit 30 includes a directional antenna 32, a date analysis module 34, and a control module 36. The directional antenna 32 can be located on a signal light bracket (not shown) to communicate with the vehicle management unit 10. In one exemplary embodiment, the directional antenna 32 can send wireless signals to the vehicle when the vehicle reaches within a range of 50-100 meters of the directional antenna 32. The directional antenna 32 is capable of receiving the RF signals sent from the antenna 18, and transmitting the RF signals to the data analysis module 34.

The data analysis module 34 is operable to count the number of vehicles of each road according to the vehicle identification information and the driving direction information, and to estimate the road condition information for each road and then feed the road condition information back to the vehicle management unit 10 through the directional antenna 32. Additionally, the data analysis module 34 has a predetermined weighting coefficient for each vehicle type according to traffic demand In this exemplary embodiment, the weighting coefficient of the public transit bus is greater than the private bus, and the private bus is greater than that of the truck. Furthermore, the data analysis module 34 is operable to count a total traffic demand index according to the weighting coefficient of all vehicles on the each road. The control module 36 is electronically connected to the data analysis module 34 to further control the road leading unit 50 according to the total traffic demand index.

Figure 2:
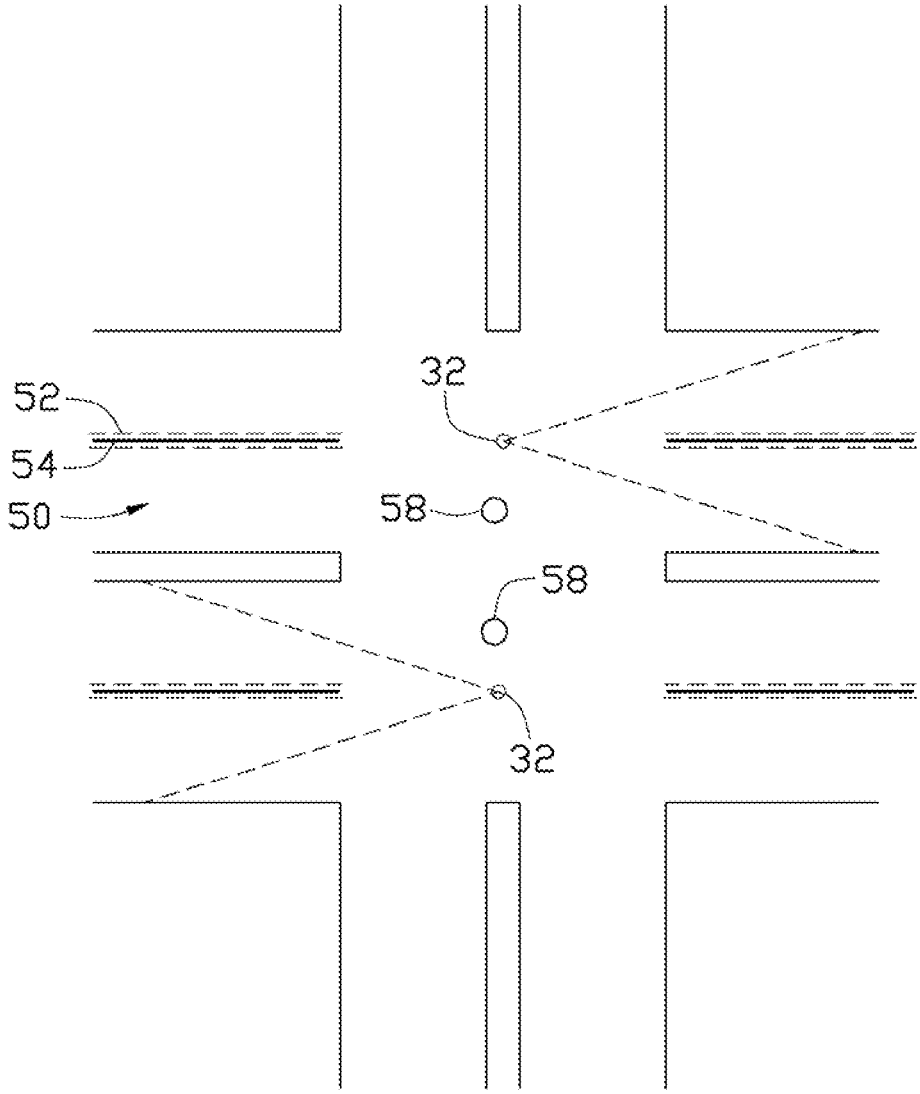
FIG. 2 is a schematic diagram of one embodiment of a road leading unit of the traffic management system as shown in FIG. 1.

Referring to FIG. 2, the road leading unit 50 includes a plurality of grooves 52, a plurality of isolation railings 54, an electric engine 56, and a plurality of signal lights 58. For example, the road can include four lanes, two grooves 52 and two isolation railings 54. One groove 52 is formed between a first lane and a second lane, and another groove 52 is formed between a third lane and a fourth lane. The isolation railing 54 can be received in a corresponding groove 52 when not in use, and can also open perpendicular to the road to divide the four lanes. The electric engine 56 is directed by the control module 36 to open or retract the isolation railing 54. The signal light 58 can be located on the signal light bracket. When the isolation railing 54 opens to divide a new lane, the signal light 58 will indicate the vehicles to drive on the new lane.

Next, an exemplary traffic management method will be described in reference to FIG. 2. When the vehicles come within a range of approximately 50-100 meters of the data processing unit 30, the vehicles can communicate with the data processing unit 30. First, the vehicle identification module 12 transmits the vehicle identification information to the signal processing unit 16, and the driving direction module 14 transmits the driving direction information to the signal processing unit 16. Then, the vehicle identification information and the driving direction information are converted into RF signals by the signal processing unit 16 and then are sent out by the antenna 18. The directional antenna 32 receives and transmits the RF signals to the data analysis module 34. The data analysis module 34 determines the number of vehicles of each road according to the RF signals, and then estimates the road condition information for the each road. The road condition information is then sent to the vehicle management unit 10 by the directional antenna 32. The signal processing unit 16 obtains the road condition information and controls the alarm device 19 thereby. The alarm device 19 can change colors of the indication lights to show the road condition information to drivers.

Meanwhile, the data analysis module 34 counts the total traffic demand index of all vehicles on the each road and then transmits the total traffic demand index to the control module 36. When the total traffic demand index of a traffic direction is significantly higher than another traffic direction, the control module 34 directs the electric engine 56 to open the isolation railing 54 located on the road with lower traffic demand index, then three lanes are supplied to vehicles in the traffic direction with higher traffic demand, and one lane is supplied to vehicles in the opposite traffic direction. At last, the control module 34 controls a corresponding signal light 58 to allocate traffic flow.

In other embodiments, the road can be six lanes or eight lanes, and the number of the isolation railings 54 can be changed correspondingly.

The traffic management unit 10 is located in the vehicles and communicates with the data processing unit 30 to estimate the road condition information for drivers. Meanwhile, the isolation railing 54 is received in the road, and the data processing unit 30 can control the electric engine 56 to open the isolation railing 54 to adjust lanes.

It is to be understood, however, that even though numerous characteristics and advantages of the exemplary disclosure have been set forth in the foregoing description, together with details of the structure and function of the exemplary disclosure, the disclosure is illustrative only, and changes may be made in detail, especially in matters of shape, size, and arrangement of parts within the principles of exemplary disclosure to the full extent indicated by the broad general meaning of the terms in which the appended claims are expressed.

What is claimed is:

1. A traffic management system, comprising:

a data processing unit communicating with a road leading unit that comprises a plurality of grooves and isolation railings, wherein the grooves are formed on a road, and the isolation railings are received in the grooves and are extendable out of the grooves opened to divide the road;

the data processing unit receiving vehicle identification information and driving direction information from a vehicle management unit, the data processing unit comprising:

a data analysis module operable to estimate road condition information and count a total traffic demand index for each road according to the vehicle identification information and the driving direction information; and a control module operable to control the isolation railings to extend out of the grooves or retract into the grooves according to the total traffic demand index wherein the isolation railings can extend or retract perpendicular to the road.

2. The traffic management system as claimed in claim 1, wherein the vehicle management unit comprises a vehicle identification module operable to predetermine the vehicle identification information.

3. The traffic management system as claimed in claim 1, wherein the vehicle management unit comprises a driving direction identification module operable to identify the driving direction information of a vehicle.

4. The traffic management system as claimed in claim 3, wherein the driving direction identification module communicates with a global positioning system module located in a vehicle.

5. The traffic management system as claimed in claim 1, wherein the vehicle management unit further comprises an antenna and a signal processing module electronically connected the antenna, the antenna communicates with the data processing unit; the signal processing module is operable to convert the vehicle identification information and the driving direction information into RF signals, and encode wireless signals received by the antenna to get corresponding electric signals.

6. The traffic management system as claimed in claim 5, wherein the vehicle management unit further comprises an alarm device, the alarm device is electronically connected to the signal processing module to show the road condition information according to the electric signals.

7. The traffic management system as claimed in claim 6, wherein the alarm device includes three indication lights positioned side by side, the middle indication light represents information of the road condition ahead of a vehicle, the left indication light represents information of the road condition on the left side of a vehicle, and the right indication light represents the right side of a vehicle.

8. The traffic management system as claimed in claim 1, wherein the vehicle management unit is located in a vehicle.

9. The traffic management system as claimed in claim 1, wherein the road leading unit further comprises an electric engine, the electric engine is directed by the control module to extend or retract the isolation railings.

10. The traffic management system as claimed in claim 1, wherein the road leading unit further comprises a plurality of signal lights, the signal lights are electronically connected the control module to indicate the vehicles when a corresponding isolation railing is opened.

11. The traffic management system as claimed in claim 1, wherein the grooves are formed between two lanes of the road.

12. The traffic management system as claimed in claim 1, wherein the data analysis module has a predetermined weighting coefficient for each vehicle type to count the total traffic demand index.

13. The traffic management system as claimed in claim 1, wherein when the total traffic demand index of a traffic direction is significantly higher than another traffic direction, the control module controls the isolation railing located on the road with lower traffic demand index to extend out of the grooves.

14. The traffic management system as claimed in claim 1, wherein the data processing unit further comprises a directional antenna, the directional antenna is electronically connected to the data analysis module and communicates with the vehicle management unit.

* * * * *